US009327894B2

(12) United States Patent
Thomas et al.

(10) Patent No.: US 9,327,894 B2
(45) Date of Patent: May 3, 2016

(54) DISPENSER PACKAGING FOR VISCOUS LIQUID COMPRISING LARGE PARTICLES

(71) Applicant: BOSTIK S.A., La Plaine St Denis (FR)

(72) Inventors: Matthew Aled Thomas, Stafford Staffordshire (GB); Robert Andrew Scott, Stafford Staffordshire (GB); Mark Phillip Houghton, Buxton Derbyshire (GB)

(73) Assignee: Bostik S.A., La Plaine St. Denis (FR)

( * ) Notice: Subject to any disclaimer, the term of this patent is extended or adjusted under 35 U.S.C. 154(b) by 0 days.

(21) Appl. No.: 14/379,757

(22) PCT Filed: Feb. 15, 2013

(86) PCT No.: PCT/IB2013/051253

§ 371 (c)(1),
(2) Date: Aug. 20, 2014

(87) PCT Pub. No.: WO2013/124773

PCT Pub. Date: Aug. 29, 2013

(65) Prior Publication Data

US 2015/0014356 A1 Jan. 15, 2015

(30) Foreign Application Priority Data

Feb. 23, 2012 (GB) ..... 1203140.7

(51) Int. Cl.
*B65D 75/58* (2006.01)
*B65D 47/06* (2006.01)

(52) U.S. Cl.
CPC ..... *B65D 75/5883* (2013.01); *B65D 47/06* (2013.01)

(58) Field of Classification Search
USPC ..... 222/107, 209, 211, 212, 215, 207, 222/566–571
See application file for complete search history.

(56) References Cited

U.S. PATENT DOCUMENTS

| | | | | | |
|---|---|---|---|---|---|
| 2,500,639 | A | * | 3/1950 | Lermer | 222/215 |
| 2,898,019 | A | * | 8/1959 | Williams | 222/551 |
| 3,248,017 | A | * | 4/1966 | Allen | 222/207 |
| 4,290,466 | A | * | 9/1981 | Villa et al. | 220/288 |
| 4,776,488 | A | * | 10/1988 | Gurzan | 222/81 |

(Continued)

FOREIGN PATENT DOCUMENTS

| | | | |
|---|---|---|---|
| FR | 1355662 | A | 3/1964 |
| GB | 2494002 | A | 2/2013 |

(Continued)

OTHER PUBLICATIONS

Great Britain Search Report from priority Patent Application No. GB1203140.7 dated Jun. 12, 2013.

(Continued)

*Primary Examiner* — Donnell Long
(74) *Attorney, Agent, or Firm* — Millen, White, Zelano & Branigan, P.C.

(57) ABSTRACT

The invention provides a dispensing system for viscous liquids comprising suspended large particulate material, the system comprising a deformable container having an outlet nozzle, the container holding the viscous liquid. It has been found that this combination of features enables a viscous liquid which may otherwise give rise to frequent blockages and difficult dispensing of a liquid through a constriction, such as in the nozzle, to be evenly, reproducibly and continuously dispensed as a manual operation.

11 Claims, 2 Drawing Sheets

(56) References Cited

U.S. PATENT DOCUMENTS

| | | | | |
|---|---|---|---|---|
| 5,388,925 | A | 2/1995 | Wilcox et al. | |
| 6,164,822 | A * | 12/2000 | Beer | 383/38 |
| 6,293,436 | B2 | 9/2001 | Faughnder et al. | |
| 6,679,304 | B1 | 1/2004 | Vacca | |
| 7,348,035 | B2 | 3/2008 | Schleifenbaum et al. | |
| 8,991,660 | B2 * | 3/2015 | Hair et al. | 222/211 |
| 2001/0003342 | A1 | 6/2001 | Faughnder et al. | |
| 2004/0234479 | A1 | 11/2004 | Schleifenbaum et al. | |

FOREIGN PATENT DOCUMENTS

| | | | |
|---|---|---|---|
| GB | 2494002 | B | 4/2014 |
| JP | 2005289489 | A | 10/2005 |
| WO | 01/32512 | A2 | 5/2001 |
| WO | 01/32512 | A3 | 5/2001 |
| WO | 2004022642 | A1 | 3/2004 |
| WO | 2013124773 | A1 | 8/2013 |

OTHER PUBLICATIONS

International Search Report from PCT/IB2013/051253 dated Nov. 29, 2012.

Written Opinion from PCT/IB2013/051253 issued on Jun. 12, 2013.

* cited by examiner

DISPENSER PACKAGING FOR VISCOUS LIQUID COMPRISING LARGE PARTICLES

The present invention relates to a packaging system, the system comprising a container and a liquid to be dispensed from the container; specifically wherein the liquid to be dispensed comprises large suspended particles the particles being large in comparison to the size of an outlet of the container.

Liquid compositions comprising suspended particles are well known and widely used. However, such compositions where more narrowly defined, have limited uses. Hence, whilst liquids comprising small particles are widely used, liquids and particularly viscous liquids comprising large particles are less frequently encountered. Further, liquids compositions of relevance in the present invention are liquid compositions of relatively high viscosity, and comprise particles which are substantially non-deformable, those particles being of significant size compared to an constriction in a passageway through which the liquid is intended to flow when dispensed from a container for manual dispensing and wherein the particles comprise a significant volume fraction of the liquid. With such compositions problems arise when attempting to accurately, evenly and continuously, dispense such liquids from such a container. It is an object of the present invention to address those problems by the provision of a packaging system suitable for manually dispensing viscous liquids comprising large particles.

The terms previously mentioned as relevant to the present document can be better appreciated by way of numerical parameters. These numerical parameters are parameters relevant to defining the present invention. A liquid composition of relatively high viscosity is a liquid composition having a viscosity greater than 100 mPa·s, more particularly greater than 500 mPa·s. This may be thought of as being a liquid of a creamy consistency. Where such liquids have a viscosity sensitive to shear rate then a shear rate of 21 $s^{-1}$ defines the condition under which the viscosity is to be determined. This may be thought of as a shear rate associated with the pouring of a relatively viscous liquid. All parameters herein are measured at a temperature of 20° C. unless otherwise defined. Particles of significant size are particles (as opposed to rods, strands and elongate objects) of 1 mm to around 4 mm in maximum dimension, and more specifically of from 2 to 4 mm in maximum dimension. A particle which is not an elongate object is considered to relate to a generally spheroidal object, i.e. where maximum and minimum dimensions do not differ by more than a factor of 1.5 times. The problem addressed by the present invention is more significant for particles which are not perfect spheres, i.e. were maximum and minimum dimensions differ by more than a factor of 1.1 times and particularly were the particle has a visually rough surface (i.e. were surface irregularities greater than 10 μm present). A significant size being a size in the sense of a comparison to a constriction in a passageway through which the liquid is intended to flow. Such a constriction is, at its narrowest point, between 4 and 20 times a particle diameter (when the particles are not spherical then the particle diameter is an average of the maximum dimension of a representative sample of 100 particles). A significant volume fraction of a liquid is a volume fraction greater than 10% by volume. An upper range for practical volume fraction is determined by the effect of particles on viscosity, for particles relevant to the present invention this is a volume fraction less than 60%. A non-deformable particle is a particle which was not change in shape when put under sufficient stress (the shear stress) to achieve a shear rate of 21 $s^{-1}$ when present in a viscous liquid.

The particles may be thought of as hard particles for the purposes of being put under the compressive force associated with pouring the liquid, i.e. a pouring or extrusion of the liquid does not deform the particles.

Liquid compositions as disclosed above are not commonly used but have found use adhesives compositions. Such compositions are typically used on a large scale industrially and are not typically applied manually. To the extent that such compositions may have been dispensed for use other than with industrial equipment it is thought that this would probably have occurred by use of a spatula or trowel from a bulk container, such as a tub or bucket.

Recently applications for liquids as defined above have been identified in the building and construction industries and as such a means for accurately, reproducibly and repeatedly dispensing such liquids manually has arisen. It is an object of the present invention to provide a packaging system comprising a container and a liquid as defined above for dispensing from the container.

The present invention in its various aspects is as set out in the appended claims with reference to the parameters as defined above.

The present invention provides:

A system for dispensing a viscous liquid the system comprising a package containing a viscous liquid, the viscous liquid comprising suspended particles of a given size at a volume fraction of greater than 5% by volume, the viscous liquid having a viscosity greater than 100 mPa·s at a shear rate of 21 $s^{-1}$, wherein the package comprises a flexible walled container having an outlet for dispensing the liquid, the outlet being of smaller cross-section than the package, the outlet having a minimum cross-sectional dimension perpendicular to the, in use, direction of flow the liquid on dispensing of between 4 and 20 times the average diameter of the suspended particles.

The a minimum cross-sectional dimension perpendicular to the, in use, direction of flow the liquid on dispensing of between 4 and 20 times, may preferably be between 5 and 10 times for demonstrating the advantages of the present invention more fully. The cross-section being measures perpendicular to the principal axis, the elongate, length axis of outlet, i.e. the direction of flow the liquid on dispensing.

The flexible walled container is flexible in the sense that it is manually deformable when containing the liquid, this to the extent that the external dimension of the container across which a direct manually applied force is placed can be recoverably deformed by a reduction in dimension of at least 20%. The provision of a flexible walled container has been found to overcome the problem of uneven dispensing of liquid within the scope of the present invention to the extent that the liquid is accurately, reproducibly and repeatedly dispensable. The combination of a viscous liquid, suspended particles and narrow outlet nozzle typically gives rise to blockage in the dispenser. The combination of manual application and a flexible, manually deformable, container has been found to overcome the problem of blockage and poor dispensing.

Whilst not wishing to be bound by theory, it is understood that using a flexible walled container, specifically one comprising a viscous liquid as outlet through a relatively narrow outlet, i.e. constriction in a passageway, requires sustained manual pressure. The user therefore naturally alters their grip, and the resulting degree of pressure applied to the container thereby changes periodically during extrusion of the liquid. The resulting deformation of the container allows a degree of suction to be created in the nozzle and thus the particles are disturbed from aggregating, or if aggregated become dislodged. Thus accurate, reproducible and repeated dispensing is obtained. To aid this process the walls of the container may be resiliently deformable, although it has been found that a bag-type container is also effective. As will be appreciated, the containers relevant for the present invention are containers which completely surround the viscous liquid such that when the contract container is compressed the liquid is forced out of an outlet, passageway, of the container.

The walls of the container may be resiliently deformable; this is preferred when the container is the form of a bottle. However, it is preferred that the walls of the container are plastically deformable if the container is in the form of a bag.

The outlet of the container is preferably a rigid outlet in the form of a passageway. The rigid outlet is preferably elongate and has a dimension in the direction of flow of the liquid on dispensing of between 3 and 20 times its cross-sectional dimension, for example as provided by a tube. Such an outlet is termed a nozzle. This outlet provides a nozzle more easily manually directed whilst holding a flexible package. The nozzle is preferably frustoconical over at least part of its length and most preferably over a larger portion proximate the container than at a narrower, outlet portion, distal from the container. This provides a nozzle, as conventionally more prone to blocking, but which more effectively dispenses the liquid as a nozzle (i.e. an elongate tube) as required in some applications. The distal portion of the nozzle is preferably terminated in an outlet defined by a plane angle (i.e. not perpendicular) to the principal long axis of the nozzle (i.e. along its length). This provides improved dispensing of the liquid, particularly in manual application.

The outlet of the container is preferably made from, or is lined with, a plastics material, such as polyethylene, or polypropylene or polyvinyl chloride. Polyethylene and polypropylene are preferred. Polyethylene is most preferred, particularly low density polyethylene, as this would appear to reduce blocking, perhaps by the mechanism of a low degree of friction between particles and the container wall. When these plastics materials are used for the container this advantageously provides the potential for a single moulding of the container and nozzle, or nozzle portion, together with providing the improved dispensing characteristics.

BRIEF DESCRIPTION OF DRAWINGS

The present invention will now be illustrated by way of diagrams which show.

Like numerals in the drawings represent like features.

Figure 1:
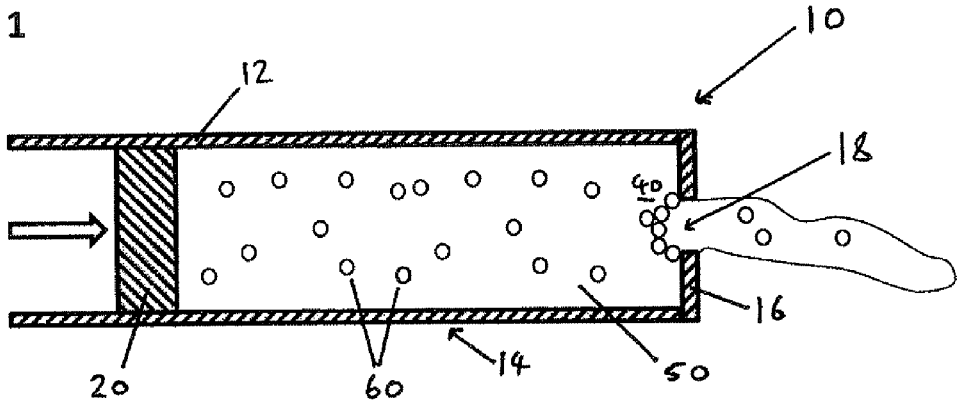
FIG. 1, rigid walled container typically used to dispense viscous building products showing blockage problem on dispensing.

The features of the drawings, FIG. 1, comprises:

10 liquid composition comprising particles in a non-deformable container not having flexible walls, the illustration being of a conventional mastic type cartridge;

12 cross-section of cylindrical wall of container 10;

14 non-deformable container in the form of a conventional mastic/sealant cartridge; These are standard cartridge sizes available in volumes of 310 ml, 350 ml, 380 ml and 1000 ml with integral diameter from 47 mm to 66 mm, a piston plunger in one end and an openable nozzle of 1 cm diameter at the other, such as obtainable from Smurfit Kappa Group.

16 end wall of container 10;

18 outlet of container acting as a constriction for the flow of liquid dispense out of the container 10;

20 piston of conventional mastic type cartridge, moved in the direction indicated by the arrow, such as by means of a manually actuated dispenser gun for dispensing the liquid from container 10;

40 blockage comprising aggregation of particles 60 from fluid 50 at the outlet 18 of the container 14;

50 viscous liquid present in container 10 ready for dispensing; and

60 illustration of suspended particles present as part of liquid 50.

Figure 2:
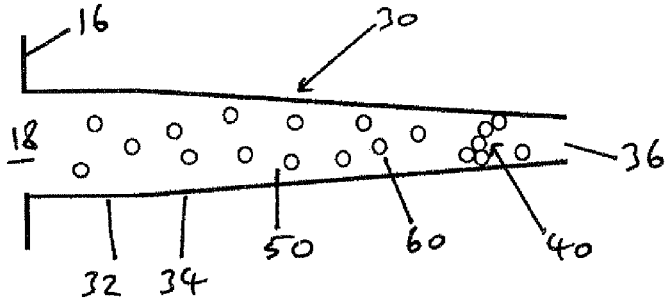
FIG. 2, preferred nozzle showing exacerbated blockage problem on dispensing.

FIG. 2 comprises the further features:

30 nozzle forming part of or attached to container 10 at end wall 16;

32 cylindrical portion of nozzle having a first end proximate to the end wall 16 and a second end distal from end wall 16 and proximate tapered, frustoconical, portion 34;

34 frustoconical portion of the nozzle having a narrowing and forming an ultimate or final outlet of the liquid distal from the main body of the container 10, 100, 200; and

36 end of frustoconical 34 portion in the form of a perpendicular end face.

Figure 4:
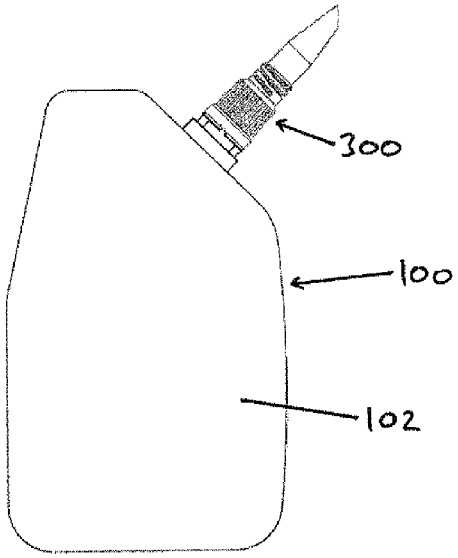
FIG. 4, illustration, inside view, of flexible low-density polyethylene container within the scope of the present invention.

FIG. 4 comprises the further features:

100 flexible walled container comprising a bottle 102 and nozzle 300 and outlet 18 (not shown) being present between the bottle and the nozzle such that when the bottle is manually compressed, such as naturally, liquid is dispensed from nozzle 300 out of final outlet 336.

Figure 5:
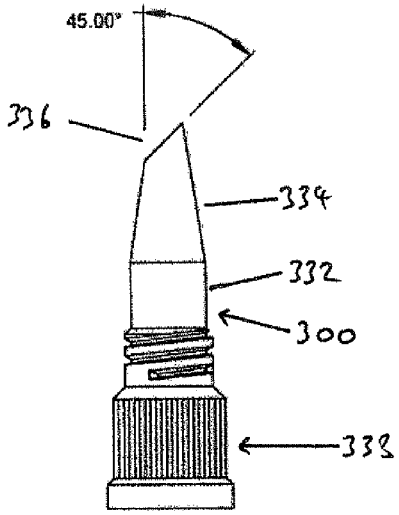
FIG. 5, illustration, inside view, of nozzle suitable for use in the present invention.

FIG. 5 showing nozzle 300 comprises the further features:

332 cylindrical portion of nozzle 300, analogous to feature 32, having optional thread along a portion of the cylinder suitable for the attachment of a cap (not shown) for the nozzle 300 such as to stop liquid 50 at outlet 336 from drying and clogging the nozzle and specifically, increasing the chances of blockage by particles due to increased liquid viscosity;

334 frustoconical portion of nozzle analogous to feature 34, the narrower ultimate outlet and of the portion being terminated in an angled section 336 of the cone 334; and

338 a knurled portion of nozzle having an internal diameter forming part of tube through 3 to for the purposes of assisting manual direction of the nozzle particularly when in conjunction with a container having very flexible walls, this feature also enabling manipulation of the nozzle relative to the container 102, 202, so as to produce the suction effect thought to enhance dispensing of viscous liquids containing particles.

Figure 6:
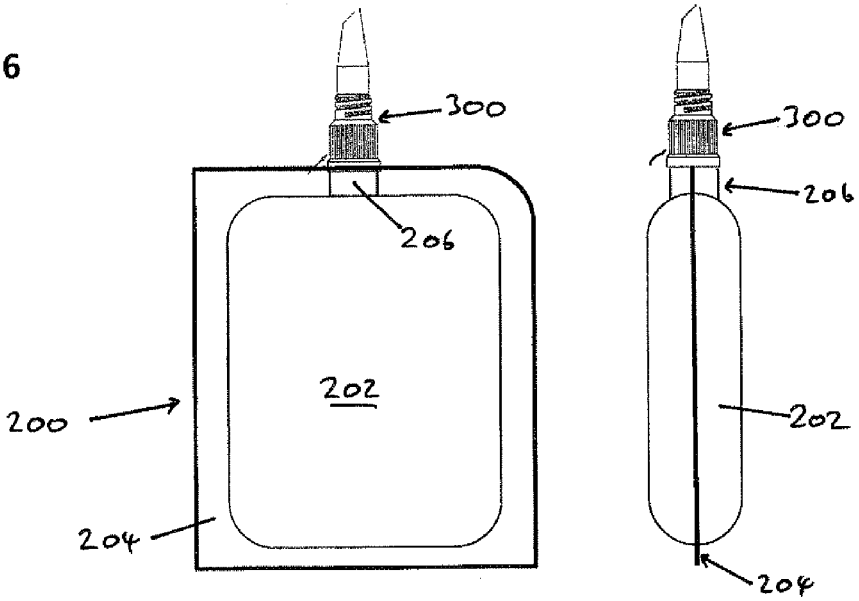
FIG. 6, which shows an illustration of, to the left, a first side view of a bag with a nozzle container and a, to the right perpendicular side view of the same bag within the scope of the present invention.

FIG. 6 comprises the further features:

200 container for liquid 50 in the form of a flexible pouch;

202 the primary container or bottle for the liquid 50 formed from 2 sheets of low-density polyethylene having a lateral seal 204, such as formed by heat sealing under pressure; and

206 tubular constriction, such as comprising a rigid or semi rigid member, to which a nozzle 300 may be secured by means such as by a thread (present under feature 338); in some embodiments the tube 206 may be integral with nozzle 300.

The features of the drawings will now be discussed.

Viscous liquids, such as used in the building construction industries are typically dispensed from a mastic cartridge, an example 14 being shown in cross-section in FIG. 1. When such container is used with a viscous liquid containing large particles it has been found that constrictions in the outlet (18, 36, 336) readily give rise to blockages 40, thought to be due to aggregations of the particles 60. It appears that the presence of particles in such a liquid when combined with a constriction in an outlet of less than 20 times, particularly less than 10 times the diameter, more particularly less than 8 times the diameter of a the particles gives rise to blockages which stop the accurate, even and continuous dispensing of such viscous liquids 50. Use of particles more than ⅓ the diameter of a constriction is barely practicable, although possible with the present invention. In instances where the particles or the outlets are of a non-circular-based geometry (ovoids, cylinders, spheres, holes) then the relevant equivalent parameter to a diameter is the smallest dimension of the feature.

It also appears that the volume fraction of the particles is key to the likelihood of blockage, a volume fraction of particles less than 5% by volume is less likely to give rise to blockages than when a volume fraction of 10% or more, particularly 15% or more, more particularly 20% or more of particles 60 are present. Hence, the benefits of the present invention increase with increasing volume fraction. However, with a volume fraction of greater than 60%, and generally more than 50%, the potential for extrusion from any container diminishes as the liquid character of compositions decreases, i.e. they become more viscous and the intrinsic potential for blockage by particle-particle interaction increases markedly. The present invention is not generally intended for use with compositions of viscosity greater than 20,000 mPa·s as these are not generally considered liquid for the purposes of the present invention.

The container 14 as shown in FIG. 1 is therefore non optimal since the constriction 18 can readily get blocked but no mechanism is present for unblocking the constriction as further pressure on piston 20 merely serves to compact the aggregate 40 blocking the constriction/outlet 18. Whilst a reversible piston 20 is the obvious technical solution to this problem an alternative solution is sought.

FIG. 2 further shows the underlying problem addressed by the present invention in which a nozzle 30 becomes blocked, particularly in a frustoconical portion of the nozzle 34 were over an extended portion of the tube 32/34, chances of blockage 40 arise. In one embodiment of the present invention the nozzle 30 may function as the flexible walled portion of the container.

Figure 3:
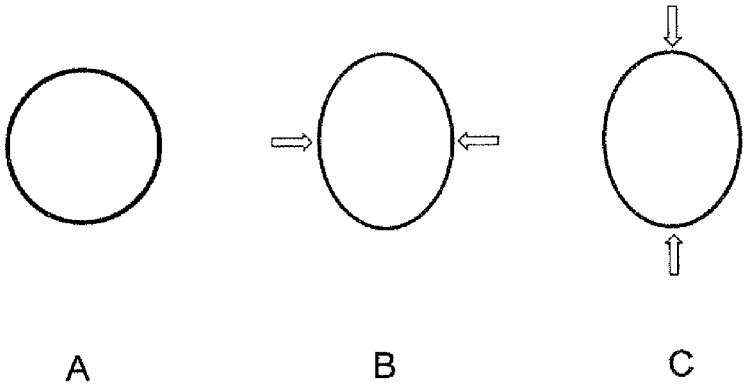
FIG. 3, illustration of possible function of flexible walled container.

FIG. 3 shows a container (100, 200) cross-section perpendicular to principal (longest) axis of an elongate container. Shows a simple cylinder (12) having rigid walls, the internal area enclosed by this structure is fixed. B shows lateral compression of a flexible walled container (further examples being 100, 200), this reducing cross-sectional area. When dispensing most liquids this is the only action required, not least because the diameter of an outlet is usually configured so as to allow ready egress of a liquid for a given pressure. However, when viscous liquids are dispensed and particularly when a blockage occurs it has been found that the natural reaction of a user is to press harder and also to alter their grip, this gives rise to situation C in which on transition from situation B geometry situation A is passed through. In other words, a possible mechanism of action of the invention is that on transitioning from reduced cross-sectional area B to reduce cross-sectional area C maximal cross-sectional area A is passed through and hence a suction (the cross-sectional area having the corresponding effect on the affective internal volume of the container) occurs thus clearing the blockage 40, or at least disrupting it such that dispensing is not hindered.

Whilst in principle it was thought that the above mechanism may give rise to problems, grip is altered and more force used (in anticipation that the blockage remains) thus giving a massive dispensing of liquid (usually causing a mess) it appears that, surprisingly, a user may get rapidly used to the feature and avoid this problem.

FIG. 4 shows a flexible walled bottle 102 forming part of a container 100 and nozzle 300. By forming the bottle out of thin-walled low-density polyethylene the benefits of the present invention when dispensing a viscous liquid comprising large particles is obtained. The irregular form of bottle shown appears to facilitate various different manual grips and thus facilitating the, change-the-grip-and-stop-blockage-occurring, feature of the present invention.

FIG. 5 shows a nozzle having an angled outlet 336. This feature appears to reduce the chances of blockage at the liquid exit constriction of the nozzle 300 compared to a similar nozzle having a perpendicular end 36.

FIG. 6 shows a container having a 'bottle' in the form of a plastic bag made from 2 sheets of edge welded low-density polyethylene. This form of container is advantageous in that little or no residual liquid is left at the end of a dispensing operation and there is no requirement that air be let into the container to replace dispensed liquid so is to keep the container in a specified shape. However, a more preferred form of the container shown in FIG. 6 is where there is no edge seam 204 as this hinders the user from laterally squashing the bag (viewed as the left-hand drawing). A preferred geometry being a 'sausage' type (elongate cylinder, preferably having rounded ends) bag/bottle. The outlet of the container is preferably placed at an end, rather than I side, of the container. This appears to increase the suction/unblocking effect described earlier. However, the most optimal geometry appears to be when the container is effectively rectangular in plan view and where the outlet is preferably at that, what would otherwise be, a corner of such a container. Such a rectangular container may be elliptical or lens shaped (the latter being the more effective) in cross-section.

Viscosity as measured herein is using a coaxial cylinder in cylinder measurement cup having a cup spacing of at least 2 times the maximum particle dimension, typically 1 cm gap, and using a Haake or Bohlin CVO 100D Rheometer at a shear rate of 21 $s^{-1}$.

The invention claimed is:

1. A system for dispensing a viscous liquid the system comprising a package containing a viscous liquid, the viscous liquid comprising suspended particles of a given size at a volume fraction of greater than 5% by volume, the viscous liquid having a viscosity greater than 100 mPa·s at a shear rate of 21 $s^{-1}$, wherein the package comprises a flexible walled container having an outlet for dispensing the liquid, the outlet being of smaller cross-section than the package, the outlet having a minimum cross-sectional dimension perpendicular to the, in use, direction of flow of the liquid on dispensing of between 4 and 20 times the average diameter of the suspended particles.

2. The system of claim 1 wherein the viscous liquid has a viscosity greater than 500 mPa·s.

3. The system of claim 1 wherein the volume fraction of suspended particles is greater than 10% by volume.

4. The system of claim 1 wherein the outlet has a minimum cross-sectional dimension between 4 and 10 times the average diameter of the suspended particles.

5. The system of claim 1 wherein the package comprises a nozzle portion in the form of a tubular extension to the package suitable for gripping manually.

6. The system of claim 5 wherein the nozzle comprises a first cylindrical portion and a second abutting frustoconical portion leading to an outlet of the liquid from the package.

7. The system of claim 5 wherein the nozzle has an outlet from the package having an end face perpendicular to the principal long axis of the nozzle.

8. The system of claim 1 wherein the container is in the form of a plastic bottle.

9. The dispensing system for viscous liquids of claim 8 wherein the outlet is an elongate tube.

10. The system of claim 1 wherein the container is in the form of a plastic bag.

11. A system for dispensing a viscous liquid, the system comprising a package containing a viscous liquid, the viscous liquid comprising suspended particles of a maximum dimension of between 1 mm to around 4 mm at a volume fraction of 5% to 60% by volume, the viscous liquid having a viscosity between 100 mPa·s and 20 000 mPa·s at a shear rate of 21 s-1, wherein the package comprises a flexible walled container having an outlet for dispensing the liquid, the outlet being of smaller cross-section than the package, the outlet having a minimum cross-sectional dimension perpendicular to the, in use, direction of flow of the liquid on dispensing, of between 4 and 20 times the average diameter of the suspended particles.

* * * * *